US011426892B2

(12) United States Patent
Völkl

(10) Patent No.: US 11,426,892 B2
(45) Date of Patent: Aug. 30, 2022

(54) CUTTING MACHINE FOR STRAND-LIKE MATERIAL, TO BE CUT

(71) Applicant: TVI Entwicklung & Produktion GmbH, Irschenberg (DE)

(72) Inventor: Thomas Völkl, Bruckmühl (DE)

(73) Assignee: TVI ENTWICKLUNG & PRODUKTION GMBH, Irschenberg (DE)

( * ) Notice: Subject to any disclaimer, the term of this patent is extended or adjusted under 35 U.S.C. 154(b) by 154 days.

(21) Appl. No.: 16/717,126

(22) Filed: Dec. 17, 2019

(65) Prior Publication Data

US 2020/0198168 A1 Jun. 25, 2020

(30) Foreign Application Priority Data

Dec. 18, 2018 (DE) ..... 102018132654.8

(51) Int. Cl.

| | |
|---|---|
| ***B26D 7/26*** | (2006.01) |
| ***B26D 1/00*** | (2006.01) |
| ***B26D 7/01*** | (2006.01) |
| *B26D 1/147* | (2006.01) |

(52) U.S. Cl.

CPC ..... *B26D 7/2628* (2013.01); *B26D 1/0006* (2013.01); *B26D 7/01* (2013.01); *B26D 1/147* (2013.01); *B26D 2001/002* (2013.01); *B26D 2007/013* (2013.01); *B26D 2210/02* (2013.01)

(58) Field of Classification Search

CPC ..... B26D 7/2628; B26D 7/01; B26D 7/0641; B26D 7/06; B26D 1/0006; B26D 1/147; B26D 2001/002; B26D 2210/02; B26D 2007/013

USPC ..... 83/676, 19, 176, 13

See application file for complete search history.

(56) References Cited

U.S. PATENT DOCUMENTS

| | | | | |
|---|---|---|---|---|
| 2010/0323591 | A1* | 12/2010 | Levsen | B24B 41/06 451/285 |
| 2011/0203434 | A1* | 8/2011 | Reifenhaeuser | B26D 1/16 83/111 |
| 2011/0226101 | A1* | 9/2011 | Volkl | B26D 7/0641 83/19 |
| 2013/0298741 | A1* | 11/2013 | Zhu | B26D 7/00 83/435.11 |
| 2014/0345434 | A1* | 11/2014 | Scattolin | B26D 1/0006 83/676 |

FOREIGN PATENT DOCUMENTS

| | | | |
|---|---|---|---|
| DE | 102010035656 | A1 | 3/2012 |
| EP | 2374581 | A1 | 10/2011 |

* cited by examiner

*Primary Examiner* — Nhat Chieu Q Do

(74) *Attorney, Agent, or Firm* — Brooks Kushman P.C.

(57) ABSTRACT

The invention concerns a device and a method for guiding a blade at a cutting end face of a guide tube by means of magnetic force in order to bring a cutting spacing between the blade and the cutting end face as close as possible. The magnetic force may be applied to the blade only towards the end of a cutting process of a slice, i.e. near a blade outlet side of a guide tube cross-section of the guide tube.

15 Claims, 9 Drawing Sheets

CUTTING MACHINE FOR STRAND-LIKE MATERIAL, TO BE CUT

CROSS-REFERENCE TO RELATED APPLICATIONS

This Application claims priority to German Patent Application No. 102018132654.8 filed on Dec. 18, 2018 to Thomas Völkl, the entire disclosure of which is incorporated herein by reference.

FIELD OF THE INVENTION

The invention concerns cutting machines in which slices are to be cut from a strand-shaped or loaf-shaped material.

BACKGROUND OF THE INVENTION

The material to be cut is often guided in a guide tube, whereby the portion of the material to be cut protruding from the guide tube on the front side of the cutting side is cut off as a slice by a rotating blade, for example, directly on the front surface of the guide tube on the cutting side.

At this point, it should be made clear that this guide tube can also consist only of an axially very short so-called cutting screen, which partially or completely surrounds the end of the material to be cut from which the slices are to be cut, and at the end face of which the blade moves along. In the following, however, only one guide tube is spoken of.

It should also be clarified that the present notification also covers solutions where a single blade cuts a slice simultaneously from two or more loaves guided in adjacent guide tubes and/or solutions where the guide tube is part of a guide tube revolver rotating about its central axis and around which several guide tubes are arranged.

The blade should always cut through the material to be cut at the same, exactly defined axial distance, in particular the distance zero, to the end face of the guide tube, because only in this way slices with a defined thickness and thus also with a defined weight can be produced.

The e.g. rotating blade is supported on the side of the guide tube by the guide tube itself, on the opposite side a support is necessary, which requires axial space—by the correspondingly large thickness of the blade itself or an additional support device there—but disadvantageous, because the penetration of the blade into the material to be cut is made more difficult.

Theoretically, an optimally thin blade would be the best solution, as it penetrates the material to be cut most easily, but such a blade often does not have sufficient dimensional stability and, above all, sufficient positional stability for lying close to the end face of the guide tube.

In the case of a product with a uniform consistency and low cutting resistance, such as sausage or cheese—which generally also has a uniform cross-section over the axial direction and is thus strand-like—this problem is not as acute as with an irregularly structured and loaf shaped product to be sliced, such as a piece of fresh meat, which can then additionally be pre-pressed in the guide tube as a shaping tube in the longitudinal direction and/or transverse direction before cutting.

The non-uniform cross-section of the meat loaf is extended to the uniform cross-section of the guide tube, so that the material to be cut has a uniform cross-section in the form of a strand or caliber, which also causes the material to be cut to be under increased pressure and which should be provided outside the guide tube with a longitudinal stop for the end of the material to be cut pushed out of the guide tube.

Since the blade is not guided on both sides in a cutting slit, but only slides along the end face of the guide tube on one side, there is a high risk, without additional measures, that the blade will not slide closely along the end face of the guide tube due to deformation, the irregular resistance of the material to be cut or other effects, in particular not contacting, but at a small distance from the end face, which undesirably changes the thickness and thus the weight of the slice produced.

Above all, however, this does not result in a good cutting result of the slice, which is only achieved if the cutting edge of the blade slides along the outlet side of the guide tube without distance and against a counter cutting edge, in this case in the form of the inner circumference of the guide tube opening of the guide tube.

If this is not the case, the edge of the slice is usually frayed, which is undesirable for optical reasons.

A grown piece of meat is surrounded by a so-called silver skin, a tendon-like material that is difficult to cut. True cutting instead of tearing through this silver skin is only possible if the cutting edge of the blade is in contact with the face of the guide tube or form revolver, especially when the blade exits the material to be cut, i.e. the cross-section of the guide tube.

It is already known from DE 10 2010 035 656 A1 that holding magnets or vacuum air nozzles are arranged in the front face of the guide tube close to the circumference of the guide tube opening in order to pull the blade towards the front face of the guide tube during the entire cutting process, preferably until it makes contact.

It has been shown, however, that this leads to increased friction between the blade and the guide tube, and thus on the one hand to a heating of these components and also of the material to be cut which is absorbed in it, and on the other hand to increased force required to move the blade.

SUMMARY OF THE INVENTION

It is therefore the objective, according to the invention, to provide a device and a method for pulling the blade towards the cutting end face of the guide tube of a cutting machine and still avoid the described disadvantages.

In the case of a generic cutting machine in which the blade is held to the end face of the guide tube by means of holding magnets, it is irrelevant whether the blade is a beam-shaped blade, a rotating circular disc-shaped blade, a rotating sickle-shaped blade or the blade of a band saw.

In a cutting machine according to the invention, the holding magnet or magnets are arranged in the direction of penetration of the blade only near the outlet side of the guide tube cross-section and outside the guide tube cross-section, and not near the inlet side.

The direction of penetration is the perpendicular to the blade edge, which is located in the blade plane defined by the blade edge and/or the main plane of the blade. If the edge of the blade is curved, the vertical one starts at the middle of the length of the edge of the blade.

As a result, the blade is only subjected to magnetic force in the direction to the end face of the guide tube in the last part of the passing distance of its blade edge through the material to be cut, i.e. through the guide tube cross-section and is thus usually brought into contact with the end face.

On the one hand, this causes the cutting edge of the blade to shear off from the front edge of the inner circumference of the guide tube cross-section as a counter-blade, which results in an exact cut, so that the silver skin is also cut correct without any problems.

In addition, this offers the advantage that before the magnetic force acts on the blade, i.e. in the first part of the cutting edge passage along the penetration distance, the blade is not yet subjected to magnetic force in the direction of the end face of the guide tube and the blade does not contact the end face or only contacts it with a very low contact force, so that there is hardly any heating of the blade and guide tube and hardly any increase in the cutting force to be applied.

In particular, the holding magnet or magnets are only arranged in the last third of the penetration distance of the blade edge in the direction of penetration.

The at least one holding magnet is arranged as close as possible to the outer circumference of the guide tube cross-section n order to apply magnetic force to the blade in the direction of the end face, especially in the area of the guide tube cross-section.

Preferably, the holding magnet is arranged transverse to the direction of penetration, i.e. in the radial direction of the guide tube cross-section, closer than 30 mm, better closer than 20 mm, better closer than 10 mm to the circumference of the guide tube cross-section.

In the axial direction, the one or more holding magnets are arranged so close to the longitudinal position of the front, cutting end face of the guide tube, that the tensile force of the holding magnet on the blade at the longitudinal position of the front, cutting end face still reaches or exceeds a predetermined minimum tensile force. The longitudinal position of the holding magnet is preferably adjustable for this purpose.

The minimum tensile force of the individual magnet mounted in the machine at the longitudinal position of the cutting end face should be at least between 10 N and 100 N, better between 20 N and 70 N, better between 30 N and 50 N especially against the blade material used.

The sum of the minimum tensile forces of all holding magnets present on a guide tube should be between 40 N and 400 N, better between 160 N and 280 N, better between 120 N and 200 N, especially against the blade material used. All holding magnets present on a guide tube should in particular be those holding magnets which, when a slice protruding from this guide tube is cut off, act jointly on the cutting blade at most.

Only then is a secure contacting of the blade edge against the front face ensured from the moment the blade is subjected to magnetic force.

The preferred material used for the blade is so-called blade steel, which is usually defined in such a way that its variety number begins with 1.40-1.46, preferably with 1.40.

In particular, the nickel content should not exceed 2.5% by weight and the carbon content should not exceed 1.2% by weight, while the chromium content should be at least 10.5% by weight, preferably 13-15% by weight. If molybdenum is present, its content should not exceed 1.0% by weight.

As a result, such blade steels are stainless and still hardenable, with hardness levels of 50-60 HRC usually being aimed for.

The counter number following in the variety number is preferably between 16 and 34 and preferably 21.

The following last two numerals of the variety number for the steelmaking process and the treatment state are preferably 3 for the steelmaking process and/or 4 for the treatment state.

Preferably a steel of the variety number 1.4021.34 is used as blade steel.

The steel used for the blade must of course be capable of being subjected to magnetic force, i.e. it must be a soft magnetic material.

Preferably the blade is positioned opposite the end face of the guide tube in the axial direction in such a way that the side of the blade facing the guide tube takes up a narrow cutting spacing of not more than 0.5 mm, better not more than 0.3 mm, better not more than 0.2 mm to the guide tube without being subjected to magnetic force.

In order to draw the blade towards the end face by means of the magnetic force of at least one holding magnet until contact is made—if the blade does not contact the end face without being subjected to magnetic force—the blade should have a thickness of not more than 10 mm, in particular not more than 8 mm, in particular not more than 6 mm, in particular not more than 4 mm, in particular not more than 3 mm.

For the same reason, the blade should have an extension of at least 10 mm in the direction of penetration, in particular at least 30 mm, in particular at least 50 mm. In the case of a disc-shaped rotating blade, the extension from the cutting edge to the bearing block in which the blade is mounted shall be measured.

The blade is usually made of a soft magnetic material anyway, i.e. a material on which a force can be exerted by means of a magnet. For hygienic reasons, the blade is preferably made of stainless steel, i.e. a high-alloy steel that does not rust under the operating conditions of such a cutting machine, but at the same time has soft magnetic properties.

Preferably, the blade is only a one-sided ground blade, whereby the ground side is preferably on the side of the blade remote from the guide tube. Therefore, regardless of the exact dimensions of the blade, i.e. its regrinding condition, no changes need to be made to the positioning of the magnets, especially in the axial direction.

DESCRIPTION OF THE SEVERAL VIEWS OF THE DRAWINGS

In the following, an advantageous embodiment of the present invention will be explained in more detail making reference to a drawing, in which the individual figures show.

DETAILED DESCRIPTION OF THE INVENTION

Figure 1A:
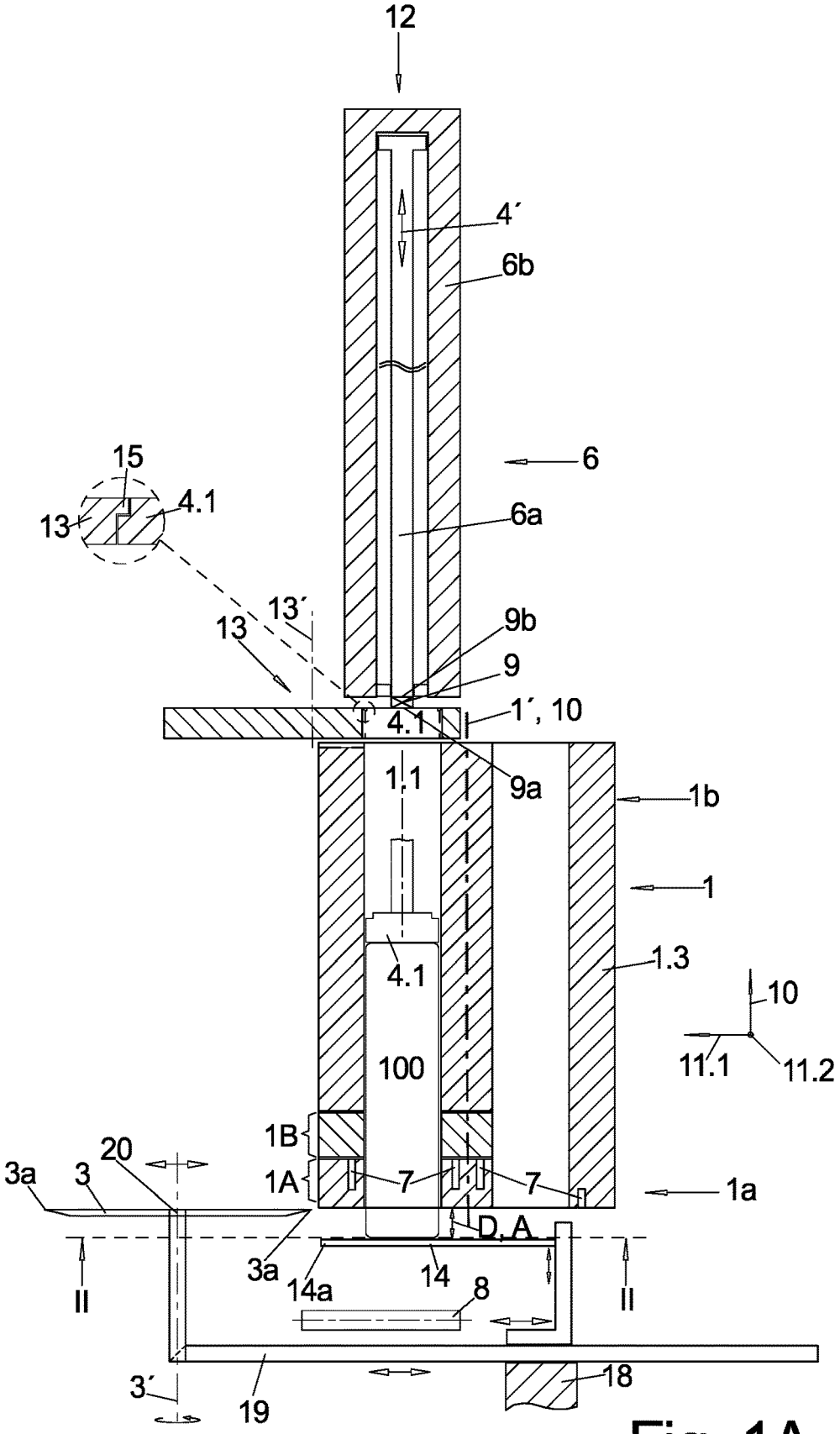
FIG. 1A is a sectional view of one embodiment of a cutting machine for cutting a material into slices in accordance with the teaching of the present disclosure showing the elements at a working position during a cutting cycle.
Figure 1B:
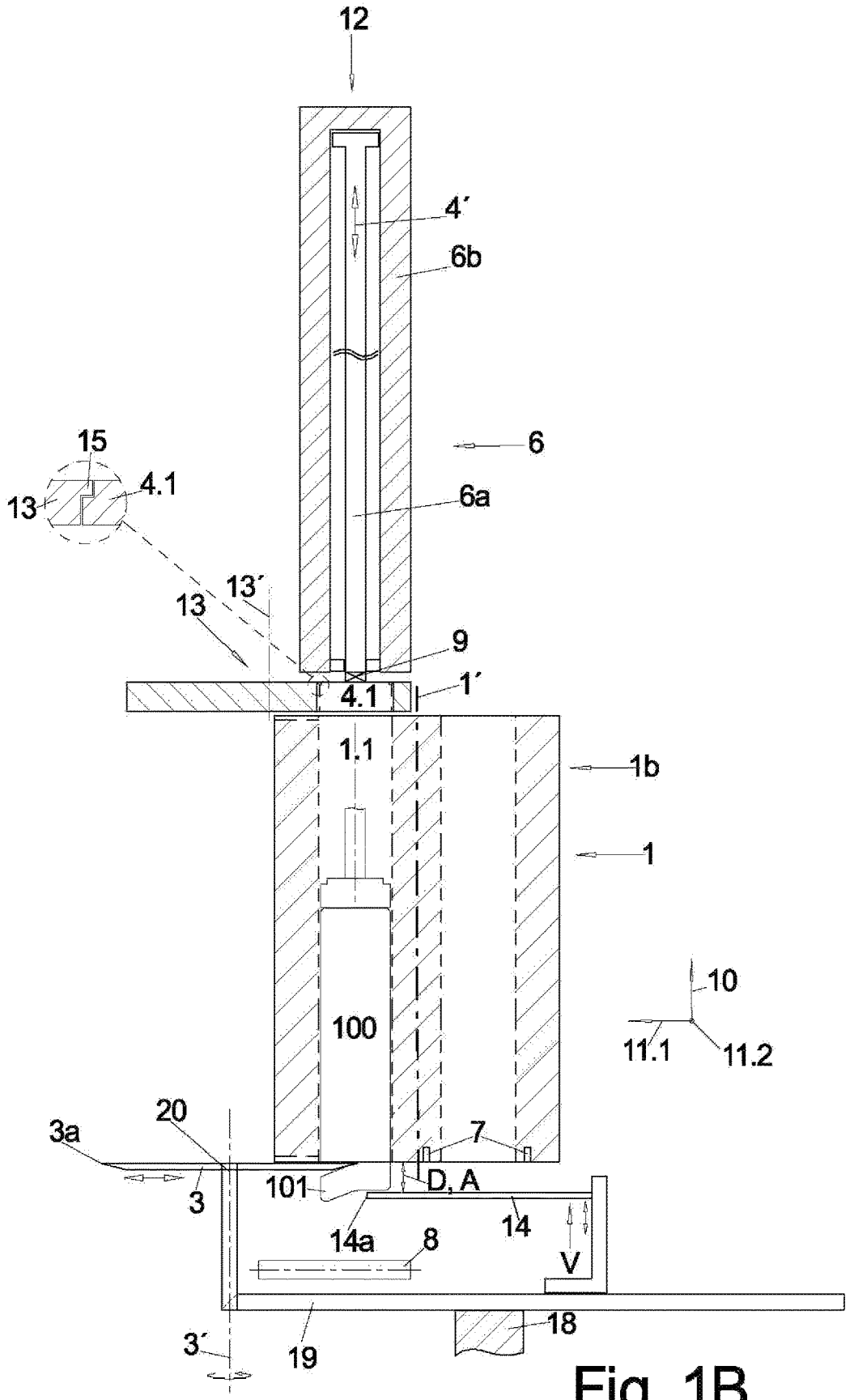
FIG. 1B is a sectional view of the cutting machine of FIG. 1A showing the elements at another working position.
Figure 2A:
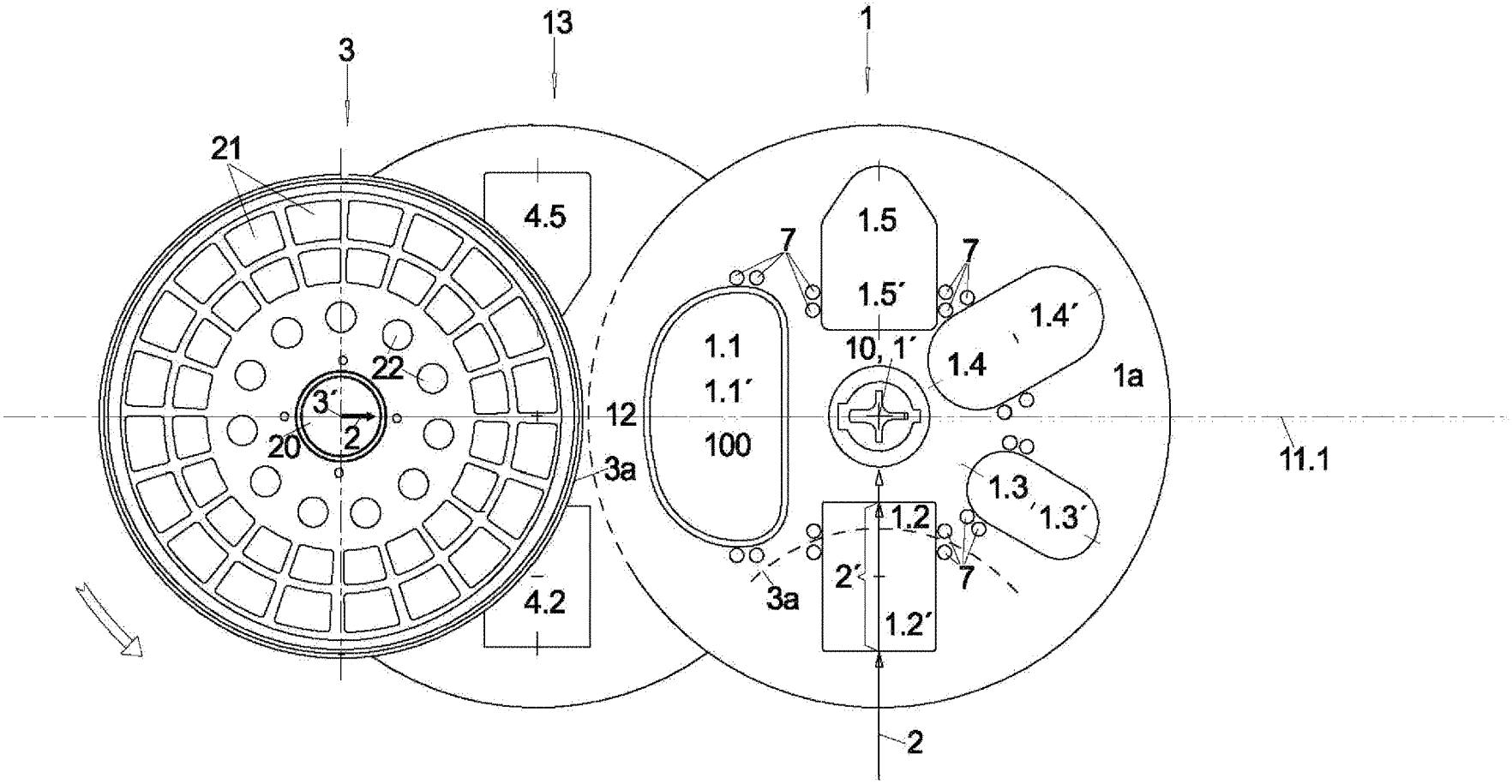
FIG. 2A is a sectional view of the cutting machine of FIG. 1A cut along the line II-II in a working position.

The basic, generic construction of the cutting machine can best be explained by looking at the FIGS. 1A and 2A together:

The invention will now be described with reference to the drawing figures, in which like reference numerals refer to like parts throughout. For purposes of clarity in illustrating the characteristics of the present invention, proportional relationships of the elements have not necessarily been maintained in the drawing figures.

The following detailed description of the invention references specific embodiments in which the invention can be practiced. The embodiments are intended to describe aspects of the invention in sufficient detail to enable those skilled in the art to practice the invention. Other embodiments can be utilized and changes can be made without departing from the scope of the present invention. The present invention is defined by the appended claims and the description is, therefore, not to be taken in a limiting sense and shall not limit the scope of equivalents to which such claims are entitled.

A guide tube revolver 1, which in this case is upright and round in cross-section, is mounted rotatably around a rotation axis or switching axis 1', which in this case is also upright and represents the axis of symmetry of the cylindrical guide tube revolver 1, in the—not shown—base frame of the cutting machine.

Along the circumference, there are several axially running guide tube openings 1.1-1.5 with different free inner cross-sections 1.1'-1.5' in the guide tube revolver 1, which are open both at the front, lower cutting end 1*a* and at the upper, rear loading end 1*b*, i.e. are each open at the end faces.

The guide tube openings 1.1-1.5 serve to receive a loaf 100 to be cut into slices, which in its initial state has an elongate but irregular shape, so that in accordance with the cross-section of the loaf 100 in its initial state it can optionally be inserted from above, from the loading end 1*b*, into a guide tube opening 1.1-1.5 with the best fitting cross-section, which must of course not be in the cutting position 12 for this purpose, since there the longitudinal press drive 6 prevents the insertion from above.

Cutting position 12 is the angular position or angular segment with respect to the axis of rotation 1' of the guide tube revolver 1 which is swept by the blade in use. In the case of a blade moved radially with respect to the guide tube revolver 1, the cutting position 12 is the angular position at which the penetration direction 2 is located.

Directly in front of, i.e. below, the lower end face 1*a*, the cutting end 1*a* of the guide tube 1, there is arranged a rotating, circular disc-shaped blade 3, which is rotationally driven about a blade axis 3', which preferably lies parallel to the switching axis 1', the axis of rotation of the guide tube revolver 1.

The rotating blade 3 can be moved back and forth in a 1st transverse direction 11.1 to the longitudinal direction 10, which corresponds to the direction of the switching axis 1' of the guide tube revolver 1, radially to the guide tube opening located in the cutting position 12, e.g. 1.1, to separate slices 101 from the material to be cut 100.

Figure 1C:
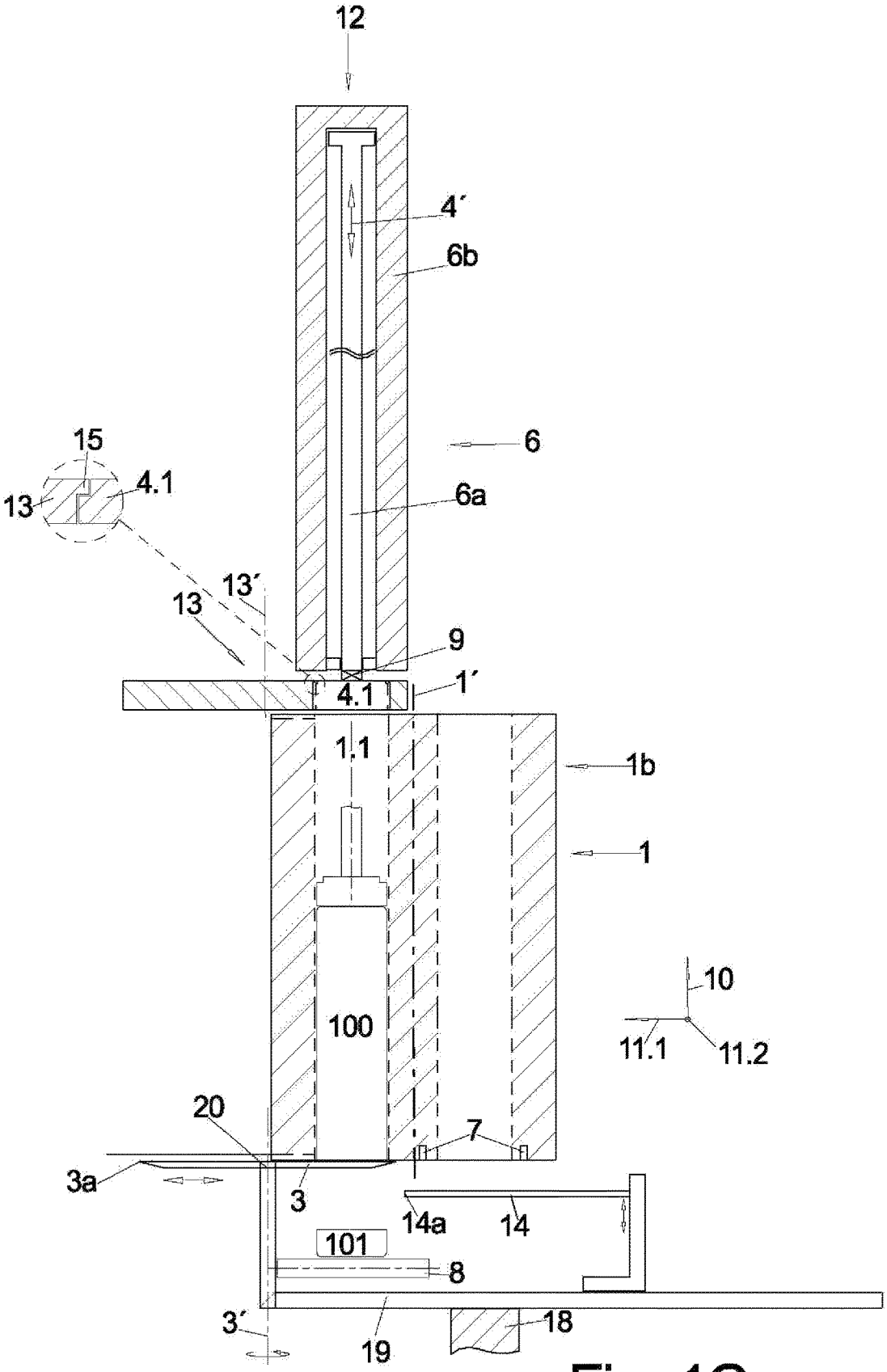
FIG. 1C is a sectional view of the cutting machine of FIG. 1A showing the elements at another working position.

The separated slice 101 falls onto the discharge conveyor 8 arranged underneath and is transported away by it, e.g. in the direction of view of FIG. 1C.

Figure 2B:
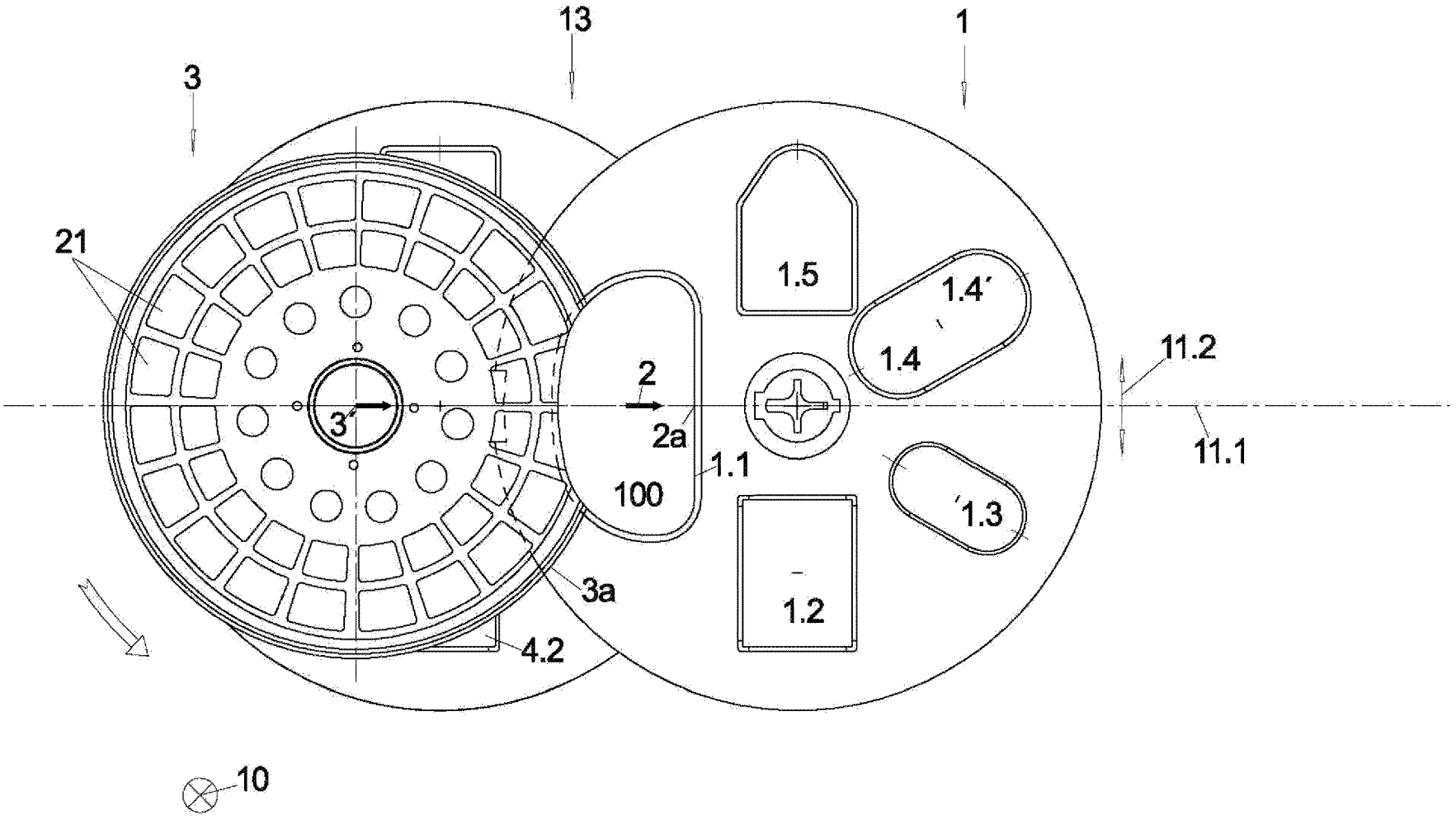
FIG. 2B is a sectional view of the cutting machine of FIG. 2A showing the elements at another working position.
Figure 2C:
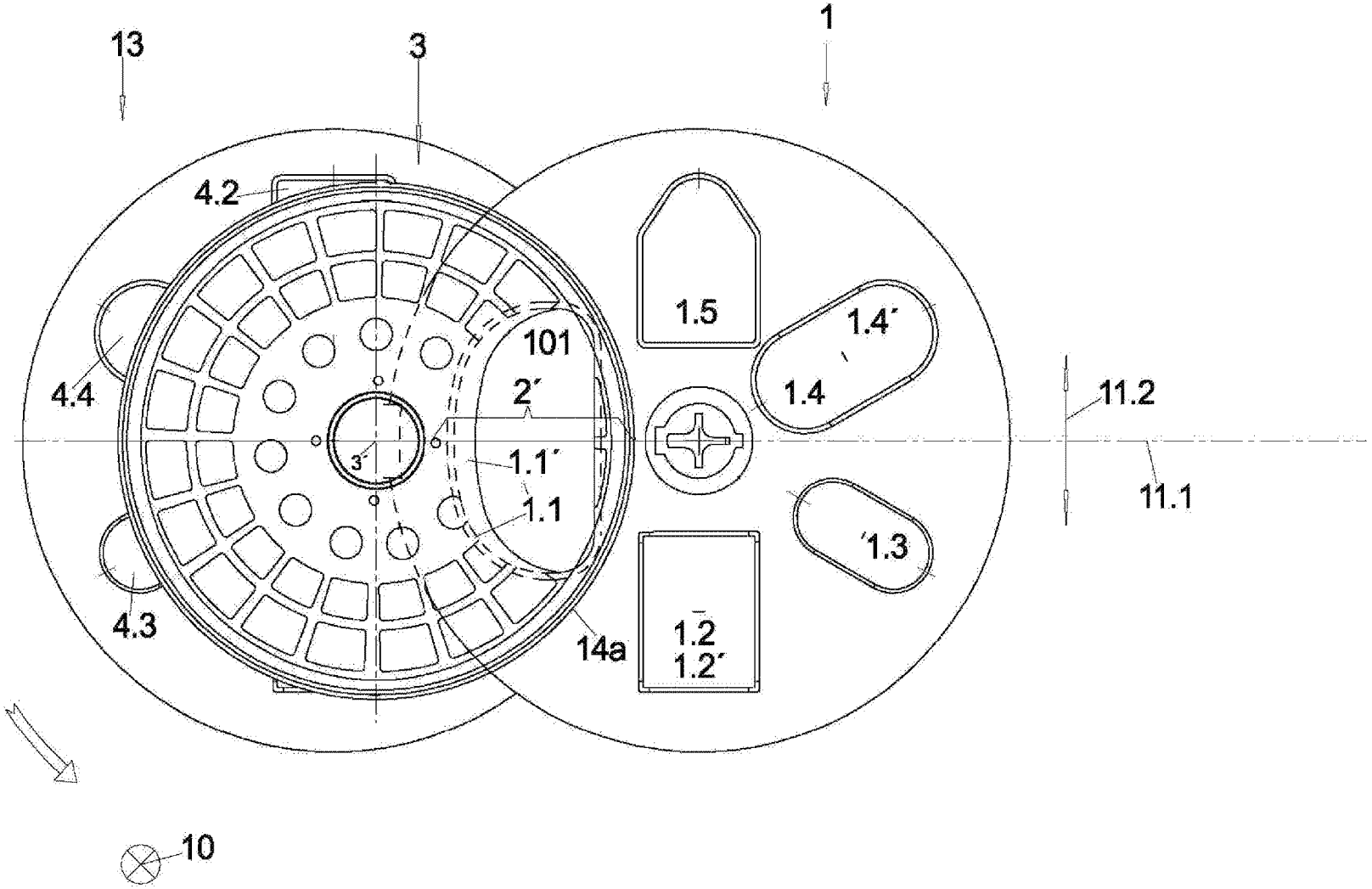
FIG. 2C is a sectional view of the cutting machine of FIG. 2A showing the elements at another working position.

FIGS. 2A to 2C show the cutting process of a slice 101 in a view according to FIG. 1A from below at position II-II.

In FIG. 2A and FIG. 1A the blade 3 is still completely outside the circumference of the guide tube revolver 1.

In FIG. 2B, blade 3 and the stop plate 14—which is not visible here—have already moved together so far to the right in the 1st transverse direction 11.1 that blade 3 has already penetrated into loaf 100 and the already cut off part of slice 101 projects beyond the functional edge 14*a* of stop plate 14 between blade 3 and stop plate 14.

In FIG. 2C and FIG. 1C the slice 101 is completely cut off, the blade 3 completely covers the cross-section of the guide tube opening at the cutting position and the stop plate 14 is completely outside the cross-section 1.1' of this guide tube opening 1.1 in this viewing direction.

FIG. 2C thus shows the condition immediately before the cut-off slice 101 falls onto the discharge conveyor 8, while in FIG. 1C the slice 101 already lies on the discharge conveyor 8.

Instead of a linear, oscillating movement in the transverse direction 11.1, the blade axis 3' may also perform an arcuate, oscillating or circular movement to cut-off one slice 101 each.

To produce a uniform cross-section of the loaf 100 before cutting, it is pressed in longitudinal direction 10 in the guide tube opening 1.1 in which it is located.

For longitudinal pressing, a longitudinal press drive 6, viewed in the direction of the switching axis 1' within the circumference of the guide tube revolver 1, is arranged on the base frame of the machine above the guide tube revolver 1 at the so-called cutting position 12.

The longitudinal press drive 6 consists of a working cylinder, preferably a hydraulic cylinder, whose piston rod 6*a*, which is displaceable in the longitudinal direction 10, progressively extends from the lower, open end of the cylinder 6*b* when the working medium is applied and, with its front end, pushes a longitudinal press piston 4.1, which fits into the cross-section 1.1' of the guide tube opening 1.1 located below, into the latter until it bears against the loaf 100 and presses the latter downwards against a stop in the longitudinal direction 10.

Figure 1D:
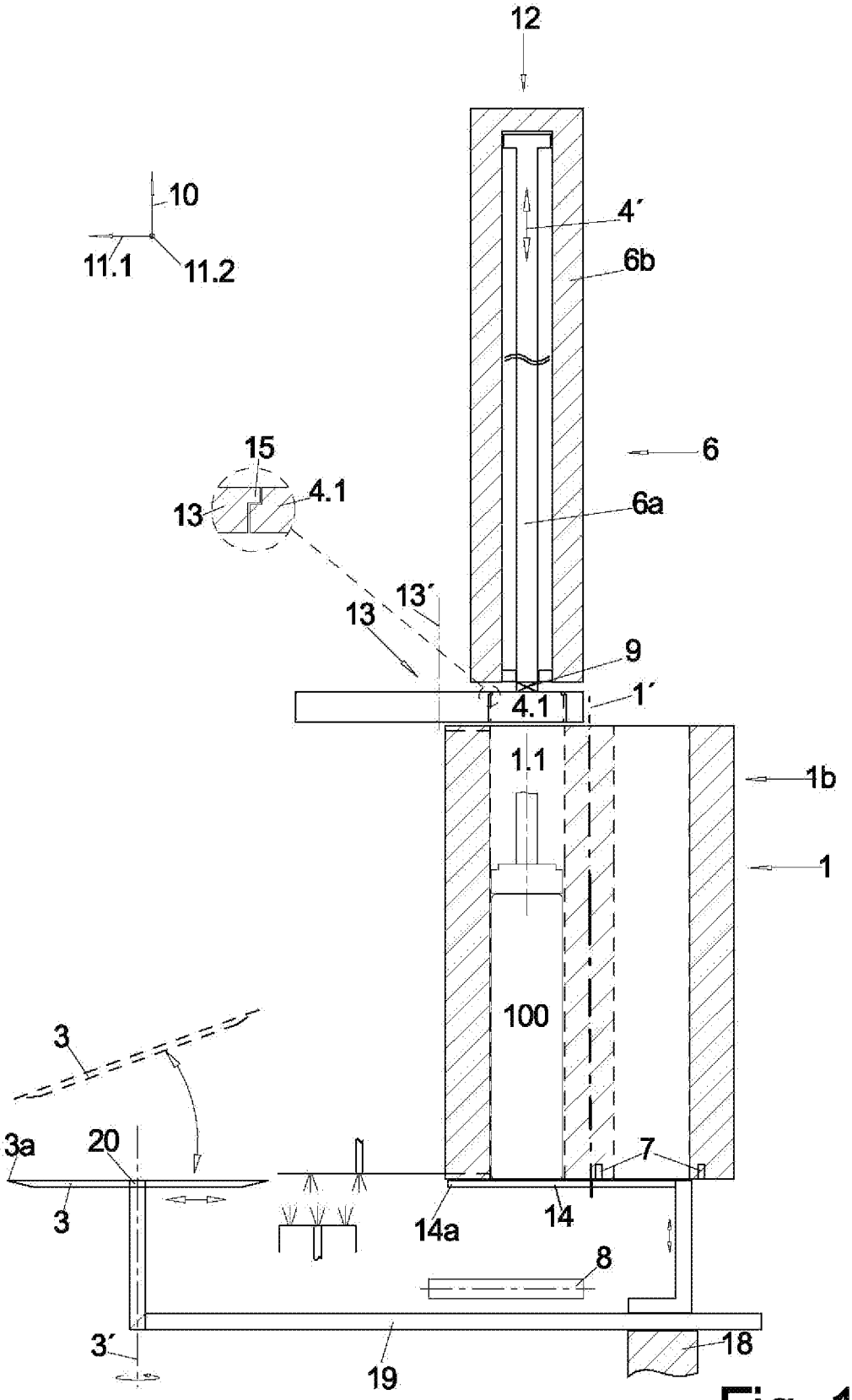
FIG. 1D is a sectional view of the cutting machine of FIG. 1A showing the elements at another working position.

In this case a stop plate 14 serves as a stop, which is moved up and held to the lower end face of the guide tube opening 1.1 in the cutting position 12 as shown in FIG. 1D, preferably completely covers this guide tube opening 1.1 before starting the cutting process.

In a slice-shaped press piston turret 13, 13' longitudinal press pistons 4.1-4.5 are arranged circularly around its axis of rotation, the cross-sections of each of which correspond to one of the cross-sections 1.1'-1.5' of the guide tube openings 1.1-1.1.5 and are arranged in the press piston turret 13 in such a way that they fit exactly and preferably liquid-tight into one of the guide tube openings 1.1-1.5 when they are in the cutting position 12 above this matching guide tube opening.

The press piston turret 13 is rotatable about the likewise upright switching axis 13', which extends parallel to the switching axis 1' but is offset relative thereto in a transverse direction, so that, at a certain guide tube opening 1.1 located at the cutting position, the longitudinal press piston 4.1 having the same cross-section 4.1' can be positioned above this guide tube opening 1.1 by corresponding rotation of the press piston turret 13.

When the lower, free end of the piston rod 6*a* approaches the upper side of the longitudinal press piston 4.1, which is still held in the press piston turret 13 and is in the cutting position 12, these are automatically connected to one another by means of a coupling 9, in that at the lower free end of the piston rod 6*a* on the one hand and/or at the upper side of each of the longitudinal press pistons 4.1-4.5 on the other hand there are corresponding co-operating coupling parts 9*a, b*.

The coupling parts 9*a* located on the upper side of the longitudinal press pistons 4.1-4.5 lie on a circular path around the switching axis 13' of the press piston turret 13. When the corresponding longitudinal press piston 4.1 is in alignment and above the cutting position 12, it is exactly in the movement path of the other complementary coupling part 9*b* arranged at the front end of the piston rod 6*a*.

When withdrawing the piston rod 6*a* with the longitudinal press piston 4.1 on it, the longitudinal press piston 4.1 moves against a piston stop 15 or in this recess when reaching the corresponding recess in the press piston turret 13, so that when withdrawing the piston rod 6*a* further, the coupling 9 is released and the corresponding longitudinal press ram 4.1, which is now held again in the press piston turret 13 in the recess provided for the longitudinal press piston 4.1, either magnetically or by suitable latching elements there.

The construction of the cutting machine is simplified by the fact that the longitudinal press drive 6 is only existing above the cutting position 12.

Switching axis 1' means that the guide tube revolver 1 can be rotated, but can also be locked in certain angular positions, so that it can be switched from one of the defined angular positions to the next.

In the following, instead of displacement direction 2 of the blade axis 3', it is always spoken of the 1st transverse direction 11.1, without limiting the invention to this, although the displacement direction 2 can also be another direction running transverse to the longitudinal direction 10 of the guide tube turret 1.

The blade 3 is mounted on a slide 19 so that it can rotate about its blade axis 3'. The slide 19 can be moved in this direction 2 relative to the cutting base frame 18. The stop plate 14 is also supported by the slide 19, but can be adjusted at least in axial direction 10, if necessary also in the radial direction.

During the cutting process, blade 3 and stop plate 14 preferably move synchronously in the penetration direction 2, preferably the 1st transverse direction 11.1, so that the resulting slice 101 is increasingly pushed through the slit between the cutting edge 3*a* of the blade 3 and the functional edge 14*a* of the stop plate 14 facing the blade.

The functional edge 14*a* is—in axial direction 10, for example when viewed from below—preferably concave curved and runs in this viewing direction aligned or slightly radially outwards, especially at a constant distance over the length of the functional edge, from the circular circumference of the cutting edge 3*a*.

Preferably the stop plate 14 and thus its functional edge 14*a* can also be adjusted in the 1st transverse direction 11.1 according to FIG. 1A in relation to the slide 19 and thus the cutting edge 3*a* of the blade 3, preferably also during the cutting process.

These and all other movements of moving parts of the cutting machine are controlled by a control not shown.

FIG. 1D shows a state of the cutting machine in which two processes are shown simultaneously, but which do not have to occur simultaneously in practice: On the one hand, the stop plate 14 has been raised to such an extent that it is in direct contact with the lower end face of the guide tube revolver 1, the cutting end 1A, as may be necessary as a stop for the longitudinal pressing of the loaf 100 at cutting position 12. Furthermore, the blade 3 is shifted so far away from the switching axis 1' of the guide tube revolver 1 that it is completely outside the cross-section of the guide tube revolver 1 when viewed in longitudinal direction 10, so that the blade 3, which is supported on its underside by the slide 19, is freely accessible from the top over its entire surface and can be removed upwards and exchanged for another blade after loosening a quick release 20.

The recesses 21 shown in FIGS. 2A to 2C arranged around the center of the blade 3, preferably on a circular path, and the openings 22 through the disc-shaped blade 3 primarily serve to reduce the weight of the blade 3 and the openings 22 also serve as gripping openings for gripping the blade 3 when changing the blade.

According to the invention, holding magnets 7 are present outside the guide tube cross-section 1.1', 1.2' in the guide tube near its cutting face 1A, but in penetration direction 2 only near the end of the penetration distance 2'.

As shown in FIG. 2A viewed in longitudinal direction 10 on both sides of each guide tube opening at least one holding magnet 7, as a rule at least two holding magnets are arranged with respect to its penetration direction 2, here the radial direction with respect to the switching axis 1' of the guide tube revolver 1 through the center of the respective guide tube opening. The at least one holding magnet 7 is arranged only in the last third of the penetration distance 2' to pull the blade 3 so that the blade edge 3*a* is in contact with the outlet end 2*a* of the penetration section 2', which is located radially inwards with respect to the guide tube revolver 1, with pretension on the end face 1*a* of the guide tube revolver 1.

Figure 4:
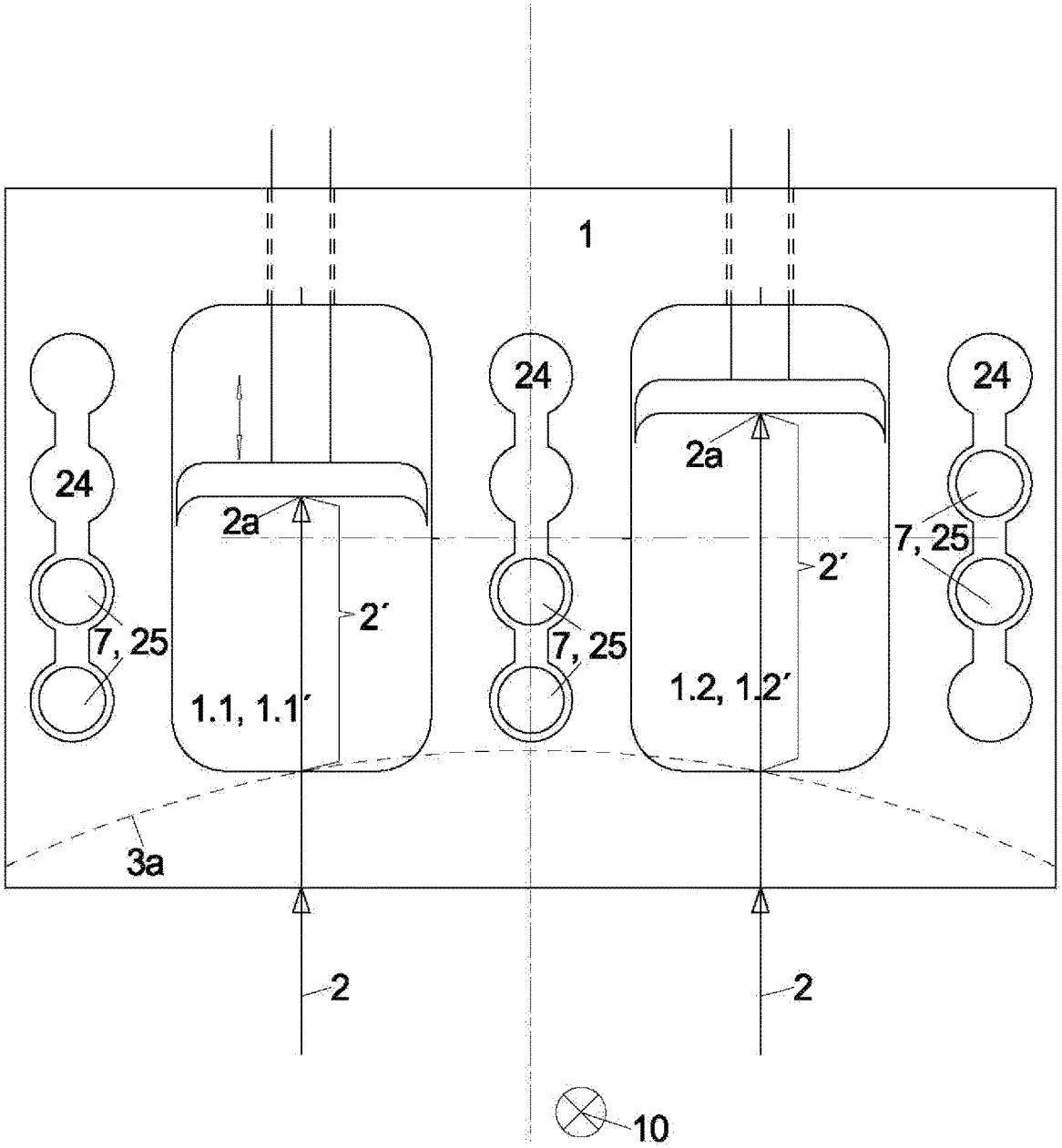
FIG. 4 is an end view of one embodiment of a double guide tube in accordance with the present disclosure.

FIG. 4 shows—again viewed in longitudinal direction 10, generally in the longitudinal pressing direction—the arrangement of the holding magnets 7 with two guide tube openings 1.1, 1.2 running parallel next to each other, which additionally allow transverse pressing of the loaf inserted therein in a first transverse direction to the longitudinal direction 10 by means of a transverse pressing piston. Since in this case the penetration direction 2 often coincides with the transverse pressing direction, the length of the penetration distance 2', which the blade edge 3*a* must cover through the cross-section of the guide tube opening, also changes with the dimension of the transverse pressing.

To adept to this change, two elongated blind holes 24 extending in the direction of penetration 2 are provided on both sides of each of the two guide tube openings, whereby a single such elongated blind hole 24 between the two guide tube openings 1.1, 1.2 is sufficient with a sufficiently small distance between the two guide tube openings 1.1, 1.2.

Along these blind holes 24, the holding magnets 7—preferably by means of a magnet holder 25, which is still to be explained—can be inserted at different longitudinal positions into these blind holes 24, namely always in the direction of penetration 2 into the last or the last two insertion positions along the penetration path T near their outlet side 2*a*.

Figure 3:
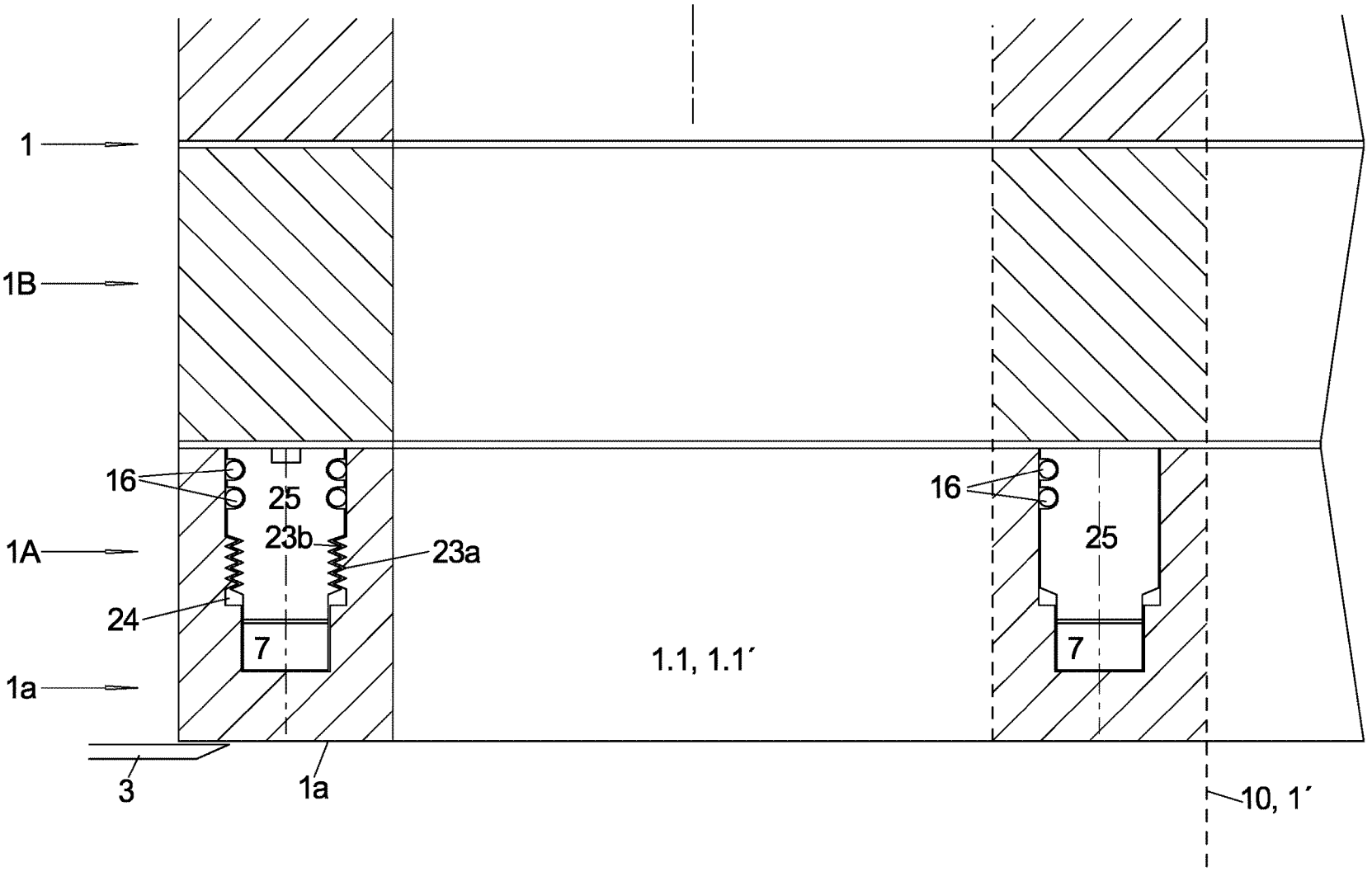
FIG. 3 is an enlarged view of a portion of the cutting machine of FIG. 1A.

FIGS. 1A and 3 show the positioning and fastening of the holding magnets 7 in axial direction 10.

FIG. 1A shows in the right edge region a guide tube revolver 1, which is formed in one piece in the axial direction 10, in the center and in the left region, on the other hand, an embodiment in which it consists of 10 consecutive discs 1A, 1B in the axial direction, of which only the first two are shown, while in practice then the entire length of the guide tube revolver 1 is composed of discs of the same thickness. The discs 1A, 1B are of course arranged and fixed in such a way that their guide tube openings 1.1,1.2 are aligned with each other.

According to FIG. 3, the holding magnet can then be inserted from its rear side into the frontmost disc 1A facing the blade 3, so that the front surface 1*a* is not interrupted by a holding magnet 7—even if inserted flush and fixed—as it is the case with a one-piece guide tube revolver 1, as shown in FIG. 1A at the lower right end of the guide tube revolver 1.

According to FIG. 3, there are blind holes 24 in the frontmost disc 1A next to the guide tube openings 1.1, and the blind holes 24 are open towards the rear of this disc 1A facing away from the front end 1*a*.

As shown in the left half of FIG. 3, this blind hole 24 can have an axial section with an internal thread 23*a* into which a magnetic holder 25 with a corresponding external thread 23*b* can be screwed, which holds the holding magnet 7 at the bottom of the blind hole 24 with its front face. The magnetic holder 25 can be sealed against the inner circumference of the blind hole 24 by means of the grooves in its outer circumference and the O-ring 16 inserted therein, or by other means.

The right half of the figure shows a much simpler design, in which the magnet holder 25—with or without sealing—has such an axial length that after inserting the holding magnet 7 into the blind hole 24 and then inserting the magnet holder 25 it is aligned with the back of the disc 1A and secured in its axial position by the following disc 1B.

From the foregoing, it will be seen that this invention is one well adapted to attain all the ends and objects hereinabove set forth together with other advantages which are obvious and which are inherent to the structure. It will be understood that certain features and sub combinations are of utility and may be employed without reference to other features and sub combinations. This is contemplated by and is within the scope of the claims. Since many possible embodiments of the invention may be made without departing from the scope thereof, it is also to be understood that all matters herein set forth or shown in the accompanying drawings are to be interpreted as illustrative and not limiting.

The constructions and methods described above and illustrated in the drawings are presented by way of example only and are not intended to limit the concepts and principles of the present invention. Thus, there has been shown and described several embodiments of a novel invention.

As is evident from the foregoing description, certain aspects of the present invention are not limited by the particular details of the examples illustrated herein, and it is therefore contemplated that other modifications and applications, or equivalents thereof, will occur to those skilled in the art. The terms "having" and "including" and similar terms as used in the foregoing specification are used in the sense of "optional" or "may include" and not as "required". Many changes, modifications variations and other uses and applications of the present construction will, however, become apparent to those skilled in the art after considering the specification and the accompanying drawings. All such changes, modifications, variations and other uses and applications which do not depart from the spirit and scope of the invention are deemed to be covered by the invention which is limited only by the claims which follow.

The invention claimed is:

1. A cutting machine for cutting a material into slices, the cutting machine comprising:

at least one guide tube extending in a longitudinal direction, the at least one guide tube having a guide tube opening at a receiving end face for receiving the material to be cut, a blade oriented transverse to the longitudinal direction and positionable at a cutting end face of the at least one guide tube, and at least one holding magnet in or at the at least one guide tube and positioned in the longitudinal direction relative to the cutting end face of the at least one guide tube so that the at least one holding magnet is able to pull the blade into contact with the cutting end face of the guide tube, wherein in a penetration direction of the blade with respect to a guide tube cross-section of the at least one guide tube, from a first side of the guide tube cross-section toward a second side of the guide tube cross-section, the at least one holding magnet is disposed closer to the second side of the guide tube cross-section than the first side of the guide tube cross-section;

wherein the cutting machine further comprises a guide tube turret comprising a plurality of discs following one another in an axial direction, wherein a holding magnet of the at least one holding magnet is inserted from a rear side into a blind hole in a frontmost of the plurality of discs facing the blade, the blind hole is open towards the rear side of the frontmost of the plurality of discs so that a front surface of the frontmost of the plurality of discs extends in front of the holding magnet, and the front surface defines the cutting end face of the at least one guide tube.

2. The cutting machine according to claim 1, wherein the at least one holding magnet is arranged transversely to the penetration direction of the blade close to a perimeter of the guide tube cross-section.

3. The cutting machine according to claim 1, wherein the at least one holding magnet is positioned in the longitudinal direction at a position relative to the cutting end face of the guide tube so that a tensile force of the at least one holding magnet at the cutting end face reaches a predetermined minimum tensile force.

4. The cutting machine according to claim 3, wherein a minimum tensile force of an individual holding magnet of the at least one holding magnet in relation to the blade is between 10 N and 100 N.

5. The cutting machine according to claim 4, wherein the at least one holding magnet comprises a plurality of holding magnets, and wherein a sum of minimum tensile forces of the plurality of holding magnets present on the at least one guide tube in relation to the blade is between 40 N and 400 N.

6. The cutting machine according to claim 1, wherein the longitudinal position of the at least one holding magnet is adjustable.

7. The cutting machine according to claim 1, wherein the blade has a thickness less than 10 mm.

8. The cutting machine according to claim 1, wherein the blade extends in the penetration direction at least 10 mm.

9. The cutting machine according to claim 1, wherein the blade comprises soft magnetic stainless steel.

10. The cutting machine according to claim 1, wherein the blade is a blade ground only on a side of the blade opposite the at least one guide tube.

11. The cutting machine according to claim 1, wherein the at least one holding magnet is arranged transversely to the penetration direction of the blade closer than 30 mm to a perimeter of the guide tube cross-section and the at least one holding magnet is detachably fastened to or at the guide tube.

12. The cutting machine according to claim 1, wherein either the blind hole has an axial section with an internal thread into which a magnet holder with a corresponding external thread can be screwed, and wherein the magnet holder holds the holding magnet with a front end face at a bottom of the blind hole, or the magnet holder has such an axial length that, after insertion of the holding magnet into the blind hole and subsequent insertion of the magnetic holder, the magnet holder is aligned with the rear side of the frontmost of the plurality of discs.

13. The cutting machine according to claim 1, further comprising a magnet holder configured to hold the holding magnet in the blind hole, wherein the magnetic holder is sealed with respect to an inner circumference of the blind hole, wherein the magnet holder is sealed by using a groove incorporated in its outer circumference and an O-ring inserted therein.

14. The cutting machine according to claim 1, wherein the blade is made of a material having a nickel content of a maximum of 2.5% by weight, a carbon content of a maximum of 1.2% by weight, and a chromium content of at least 10.5% by weight.

15. The cutting machine according to claim 1, wherein the blade has a blade edge that is movable relative to the guide tube cross-section in the penetration direction and along a penetration distance from the first side to the second side of the guide tube cross-section, and wherein the at least one holding magnet is arranged only in a last third of the penetration distance.

* * * * *